US006233958B1

(12) United States Patent
Mei et al.

(10) Patent No.: US 6,233,958 B1
(45) Date of Patent: May 22, 2001

(54) HEAT PUMP WATER HEATER AND METHOD OF MAKING THE SAME

(75) Inventors: Viung C. Mei, Oak Ridge; John J. Tomlinson; Fang C. Chen, both of Knoxville, all of TN (US)

(73) Assignee: Lockhead Martin Energy Research Corp., Oakridge, TN (US)

( * ) Notice: Subject to any disclaimer, the term of this patent is extended or adjusted under 35 U.S.C. 154(b) by 0 days.

(21) Appl. No.: 09/396,061

(22) Filed: Sep. 15, 1999

(51) Int. Cl.[7] ..... F25B 27/00
(52) U.S. Cl. ..... 62/238.7
(58) Field of Search ..... 62/238.6, 238.7; 237/19, 2 B

(56) References Cited

U.S. PATENT DOCUMENTS

| | | | | |
|---|---|---|---|---|
| 4,173,872 | * | 11/1979 | Amthor | 62/238 |
| 4,256,059 | * | 3/1981 | Roggow et al. | 62/238.6 X |
| 4,293,323 | * | 10/1981 | Cohen | 62/238.6 |
| 4,320,630 | | 3/1982 | Uselton et al. | 62/238.6 |
| 4,487,032 | | 12/1984 | Speicher | 62/183 |
| 4,507,933 | | 4/1985 | Chapa et al. | 62/184 |
| 4,773,231 | | 9/1988 | Sulzberger | 62/238.6 |
| 5,052,187 | * | 10/1991 | Robinson | 62/238.6 X |

FOREIGN PATENT DOCUMENTS 724409 2/1955 (GB) ..... 29/64

OTHER PUBLICATIONS

Althouse et al.; Modern Refrigeration And Air Conditioning; The Goodheart–Willcox Co., Inc., p. 492, 1996.*

* cited by examiner

*Primary Examiner*—Corrine McDermott
*Assistant Examiner*—Chen-Wen Jiang
(74) *Attorney, Agent, or Firm*—Needle & Rosenberg, P.C.

(57) ABSTRACT

An improved heat pump water heater wherein the condenser assembly of the heat pump is inserted into the water tank through an existing opening in the top of the tank, the assembly comprising a tube-in-a-tube construction with an elongated cylindrical outer body heat exchanger having a closed bottom with the superheated refrigerant that exits the compressor of the heat pump entering the top of the outer body. As the refrigerant condenses along the interior surface of the outer body, the heat from the refrigerant is transferred to the water through the outer body. The refrigerant then enters the bottom of an inner body coaxially disposed within the outer body and exits the top of the inner body into the refrigerant conduit leading into the expansion device of the heat pump. The outer body, in a second embodiment of the invention, acts not only as a heat exchanger but also as the sacrificial anode in the water tank by being constructed of a metal which is more likely to corrode than the metal of the tank.

17 Claims, 3 Drawing Sheets

HEAT PUMP WATER HEATER AND METHOD OF MAKING THE SAME

GOVERNMENT LICENSE RIGHTS

This invention was made with Government support under Contract No. DE-AC05-96OR22464 awarded by the U.S. Department of Energy to Lockheed Martin Energy Research Corp. and Contract No. DE-AC05-84OR21400 awarded by the U.S. Department of Energy to Lockheed Martin Energy Systems, Inc., and the Government has certain rights in this invention.

BACKGROUND OF THE INVENTION

A. Field of the Invention

This invention relates generally to the combination of a heat pump and a water heater and, more specifically, to the construction of a condenser assembly of the heat pump water heater and its being inserted into the tank through an existing opening in the top of the water tank.

B. Description of the Prior Art

Heat pump water heaters (HPWH) are an energy-efficient way to heat water with electricity, typically providing the same amount of hot water at one-half to one-third the energy used in electric resistance water heaters. A HPWH works by transferring heat, not be creating heat. Through a reverse application of the standard vapor compression refrigeration cycle, a heat pump water heater uses an electrically driven compressor to remove heat energy from a low-temperature heat source (ambient room air) and move it to a higher-temperature heat sink, the water stored in the hot-water tank. The energy supplied to heat the water is primarily electrical energy needed to operate the compressor. The energy supplied to heat the water comes from both the heat transferred from the ambient air and the energy used to operate the compressor in the system. Because less energy is needed to move heat than to create heat, the effective efficiency of the heat pump water heater system, defined as the ratio of hot water energy output to energy input to the water heater, is greater than 100%. The effective efficiency is called the Coefficient of Performance (COP).

A typical residential HPWH operates by extracting heat from a moderate-temperature source (such as room air), and moving it to a higher-temperature heat sink, the residence hot-water supply. This heated water is then stored in a hot-water storage tank for later use. The physics and operation of the HPWH is identical to the vapor compression refrigeration/heat pump cycle used for space conditioning heat pumps, air conditioners, and refrigerators. FIG. 2 shows the components used in a vapor compression refrigeration/heat pump cycle: compressor, condenser, evaporator, and expansion device. The flow of refrigerant between components in this closed cycle is also illustrated.

In the compressor, refrigerant vapor is compressed, thereby raising its temperature and pressure. This vapor then moves to the condenser. In the condenser, heat flows from the hot refrigerant to water surrounding the condenser. As heat leaves the refrigerant, the refrigerant condenses to a high-pressure, liquid state. The heat removed from the refrigerant as it changes to a liquid is transferred to the water.

The high pressure, liquid refrigerant leaves the condenser at a temperature slightly above the temperature of the water surrounding the condenser. The liquid passes to an expansion device, where it is rapidly depressurized, and some of the liquid refrigerant flashes back into vapor. The vaporization of a portion of the refrigerant causes the remaining refrigerant to cool rapidly, and the refrigerant leaves the expansion device as a low-temperature mixture of fluid and vapor. This cold mixture then enters the evaporator, where it absorbs heat from air blown over the evaporator coils. The liquid portion of the refrigerant evaporates, and the vapor then moves back to the low-pressure side of the compressor at a temperature slightly below the temperature of the heat source.

This continuing cycle results in movement of heat from the ambient air to the higher-temperature residential hot-water supply. In residential HPWHs, the heat source is typically air from inside the residence, although with proper duct design, the air could come from inside the residence, from outdoors, or can be set manually to come from either depending on climate conditions.

Electrical energy is required to operate both the compressor in the HPWH and a fan that continually blows air across the evaporator coils when the unit is operating. Depending on the system design, a water pump may also be needed to circulate water between the condenser and the storage tank. The compressor, however, is the major electrical load in an HPWH. Most of the energy consumed by the compressor is used to compress and subsequently heat the refrigerant vapor, with only a small fraction of energy lost as heat from the shell of the compressor. Since the total energy to the hot water comes from the energy transferred from the heat source, as well as virtually all the energy that is used by the compressor, the net amount of heat energy transferred to the hot water is considerably higher than the net input of electrical energy by the compressor. In residential HPWHs, the heat energy supplied to the water is typically between two and three times the amount of electrical energy required to operate the HPWH.

By contrast, electrical energy in a standard electric water heater is converted directly to heat in an electrically resistive element. Since the conversion efficiency from electrical energy to heat energy is 100% and the element is completely immersed in the water, the amount of heat energy supplied to the water in a standard electric water heater is equal to the electrical energy supplied to the elements. By providing more hot water per unit of electricity consumed, the HPWH saves energy and money.

Residential HPWH units are wired with electrical resistance backup for heating water during period when the HPWH will not operate satisfactorily. Backup electric resistance heat may prove necessary if the heat pump unit fails, or if the temperature of the heat source is too low for the HPWH to operate effectively. Some designs also allow the use of backup resistance heat if the hot-water load is significantly above the heat pump capacity.

There are basically two types of HPWHs currently available on the market. One is the desuperheater, which is connected to a heat pump system that is used for house cooling and heating. The desuperheater takes part of the heat from the compressor discharge gas and use it for domestic water heating. The problem with a desuperheater HPWH is that the house load might not match the water heating load. In other words, when hot water is needed, the house might not need cooling or heating, is and this results in inefficient use of the heat pump system.

Another type of HPWH is a dedicated stand alone unit. It pumps water from the water or storage tank, heats it in the HPWH using a heat pump and then circulates it back to the storage tank. While an advantage of the stand-alone is that storage tanks ox HPWH units can be replaced separately as they wear out, this type of HPWH is bulky and requires a water pump to pump water from the tank to and from the condenser. The cost for such a HPWH tends to be high. An HPWH produced by Crispaire Corp. of Norcross, Ga. (Model R106K3) is mounted on the water tank.

There is a third type of HPWH, which is not on the market yet, but has been designed and developed. In this new design, the condenser coils are wrapped around over half of the exterior of the tank wall with the balance of the refrigeration system (including controls, expansion device, compressor, fan and evaporator assembly) being mounted on top of the tank. Thus, the water is heated by heating the tank walls with the obvious disadvantage being that the condenser is not in direct contact with the water so as to have the most efficient heat transfer occur. The system is designed to be a single package, including the modified tank. This type of HPWH requires special manufacturing to wrap the copper coil around the tank wall. Also, contact resistance between wall and the coil must be minimized to insure proper system operation. Again, in case the tank must be replaced, the condenser coil will have to be cut, which involves taking refrigerant out of the heat pump first. Then, a new tank, with the coil wrapped around its wall, will have to be connected to the compressor-evaporator assembly, and then evacuation and refrigerant charging. Full replacement of the entire system will likely be the best option, and first or replacement costs could be high. Enviromaster International (EMI), with support from the Department of Energy's ENERGY STAR Program through Oak Ridge National Laboratory, is developing this type of HPWH aimed at the large electric water heater replacement market.

SUMMARY OF THE INVENTION

The above disadvantages of the prior art are overcome by the present invention wherein the unit of the HPWH is an integral part of the water tank by mounting the heat pump unit on top of the water tank and inserting a condenser assembly into the water tank through an existing opening, such as the hole in the top cover for the anode rod. The condenser assembly is of a tube-in-a-tube design.

Specifically, the present invention is an improved heat pump water heater of they type having a water tank with an exterior surface and being formed of a first metal and defining a water chamber, a top on the water tank with at least one opening therethrough and a heat pump of the type having a compressor being in fluid communication with a condenser assembly via a first refrigerant conduit, the condenser assembly being in fluid communication with an expansion valve through a second refrigerant conduit, the expansion valve being in fluid communication with an evaporator through a third refrigerant conduit and the evaporator being in fluid communication with the compressor through a fourth refrigerant conduit. In the first embodiment of the present invention, the improvement comprises the condenser assembly being formed of an outer body and having a closed bottom and an opposed upper end which is in flow communication with the first refrigerant conduit and an inner body disposed within the outer body and having an open bottom and an opposed top which is in flow communication with the second refrigerant conduit. In this manner, superheated vapor from the compressor enters at the top of the outer body from the first refrigerant conduit and condenses along the length of the outer body with heat from the refrigerant in the first refrigerant conduit being transferred through the outer body to the water in the water tank. The condensed refrigerant then travels up through the inner body into the second refrigerant line.

The first embodiment can be used, for instance, where there are two anode rod holes. One of those openings can be used for the condenser assembly where both the outer and inner bodies are made from conventional materials, such as copper.

In the second embodiment of the present invention, the condenser assembly of the present invention replaces the existing anode rod in the water tank and the assembly is disposed within the tank through the existing anode hole in the tank top. In the second embodiment, the tank wall is constructed of a first metal and the improvement comprises having the condenser assembly being formed of an outer body constructed of a second metal capable of corroding at a rate greater than the rate of corrosion of the first metal and having a closed bottom, an opposed upper end which is in flow communication with the first refrigerant conduit and an inner body disposed within the outer body and having an open bottom and an opposed top which is in flow communication with the second refrigerant conduit. Thus, the outer body functions both as an anode as well as a heat exchanger with the refrigerant flowing through the condenser assembly in the same manner as in the first embodiment.

Thus, the second embodiment is preferably utilized if there is only one anode rod hole on the tank. In the construction of the condenser assembly of the second embodiment, the second metal for the outer body of the condenser assembly is selected from the group consisting of aluminum, magnesium or zinc and the inner body is formed of copper.

Both embodiments of the present invention avoid the need for an additional water pump as the connection HPWH's or wrapping the condenser around the water tank. Because the immersed heat exchanger is in direct contact with the water, the heating efficiency of the present invention will be high.

The present invention will save space, labor, and cost to manufacture. Most important, the invention can be added on to an existing water tank without any modification of the water tank so that it will be easier for water heater tank manufacturers to accept this type of HPWH and incorporate it into existing product lines.

BRIEF DESCRIPTION OF THE FIGURES OF DRAWINGS

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described, in which like numbers indicate like parts throughout the figures.

Figure 1:
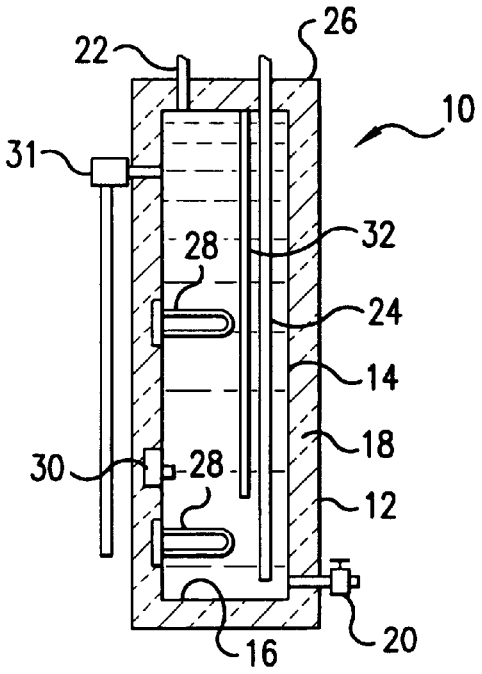
FIG. 1 is a vertical cross-sectioned schematic view of a conventional electric water heater.

FIG. 1 is a schematic view of a conventional electric water heater 10 comprising the following elements: an outer metal case 12 with a heavy inner steel tank 14 that holds the hot water. Typically, the tank 14 holds 40 to 60 gallons. The steel tank 14 normally has a bonded glass liner 16 to keep rust out of the water. Insulation 18 surrounds the tank 14. A drain valve 20 to drain the tank 14 extends through the metal case 12 adjacent the bottom of the water heater 10. A dip tube 22 to let cold water into the tank 14 and a pipe 24 to let hot water out of the tank 14 extend vertically through the top or cover 26 of the tank 14. Heating elements 28 to heat the water extend into the interior of the tank 14. A thermostat 30 to control the temperature of the water inside the tank 14 is disposed on the outside of the case 12.

A sacrificial anode rod 32 downwardly extends from the cover 26 into the water within the tank 14. Anodes of metals such as aluminum, magnesium, or zinc are sometimes installed in water heaters and other tanks to control corrosion of the tank. The introduction of the anode creates a galvanic cell in which the magnesium or zinc will go into solution (be corroded) more quickly than the metal of tank 14 thereby imparting a cathodic (negative) charge to the tank metal(s) and preventing tank corrosion. This corroding of the anode metal is called "the sacrifice of the anode."

Figure 2:
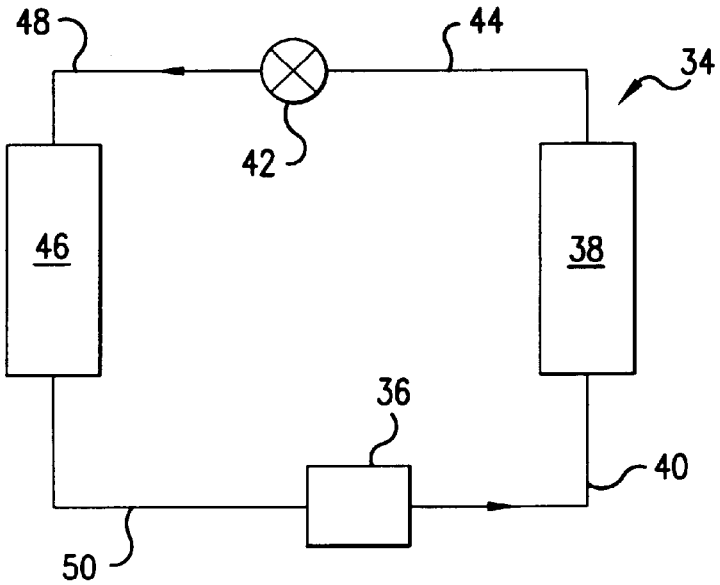
FIG. 2 is a schematic view of the major components of a conventional heat pump.

FIG. 2 schematically depicts the major components of a heat pump 34 which comprises a compressor 36 being in fluid communication with a condenser 38 through a first refrigerant line 40, the condenser 38 being in fluid communication with an expansion device 42 through a second refrigerant line 44, the expansion device 42 being in fluid communication with an evaporator 46 through a third refrigerant line 48 and the evaporator 46 being in fluid communication with the compressor 36 through a fourth refrigerant line 50. An electric fan 52 is associated with the evaporator 46. The conventional controls means for the heat pump 34 are not shown.

Drawn by the compressor 36, refrigerant gas (vapor) leaves the evaporator 46 at low pressure and low temperature and flows through the fourth refrigerant suction line 50 to the compressor 36. As the compressor 36 compresses the vapor to a higher pressure, its temperature rises so that the refrigerant leaves the compressor 36 as a high-temperature gas at high pressure. The compressor 36 pushes the hot, high-pressure refrigerant vapor through the first refrigerant or discharge line 40 to the condenser 38. The condenser 38 is simply a heat exchanger that removes heat from the hot gas and releases it to a heat sink which, for heat pump water heaters, is the water heater 10. The removal of heat from the hot gas causes it to condense to a liquid with the condenser heat being used to heat the water.

Refrigerant leaves the condenser 38 as an intermediate-temperature liquid at high pressure through the second refrigerant or liquid line 44 to the expansion device 42. By acting as a flow restrictor, the expansion device 42 maintains high pressure on the condenser side and low pressure on the evaporator side. In larger commercial heat pump water heaters, the expansion device 44 is an expansion valve. In smaller systems, it may be a capillary tube.

As the liquid moves through the expansion device 42, its pressure is suddenly lowered. The pressure drop causes some of the liquid refrigerant to flash (evaporate very quickly) into vapor. The evaporation of a portion of the liquid cools the remaining liquid so that the refrigerant leaves the expansion device 42 as a low-temperature mixture of gas and liquid at low pressure which then flows through the third refrigerant line 48 to the evaporator 46. The evaporator 46 is another heat exchanger that allows heat to move from a heat source (the air inside a building for most air-source HPWHs) to the refrigerant. As the liquid refrigerant evaporates to a gas, the evaporator 46 removes heat from the heat source. In an air-source HPWH, the evaporator 42 provides a cooling and dehumidification effect to the building interior as it removes heat from the air. The refrigerant leaves the evaporator 46 through the fourth refrigerant line 50 as a low-temperature gas at low pressure and enters the compressor 36 completing the cycle.

Figure 3:
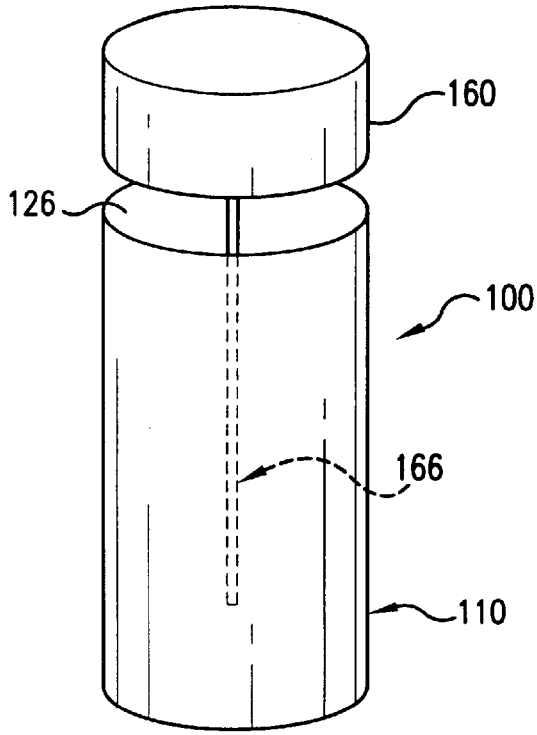
FIG. 3 is a perspective schematic view of the exterior of the heat pump water heater of the present invention with the heat exchanger exploded away from the hot water tank.

In combining a heat pump 34 with a water heater 10, to produce a heat pump water heater 100, as shown schematically in FIG. 3, an energy-efficient system is created to heat the water so as to provide the same amount of hot water at possibly one-half to one-third the energy used in an electric resistance water heater 10. Considerably more energy is transferred to the water in the tank than is used to operate the heat pump.

Figure 4:
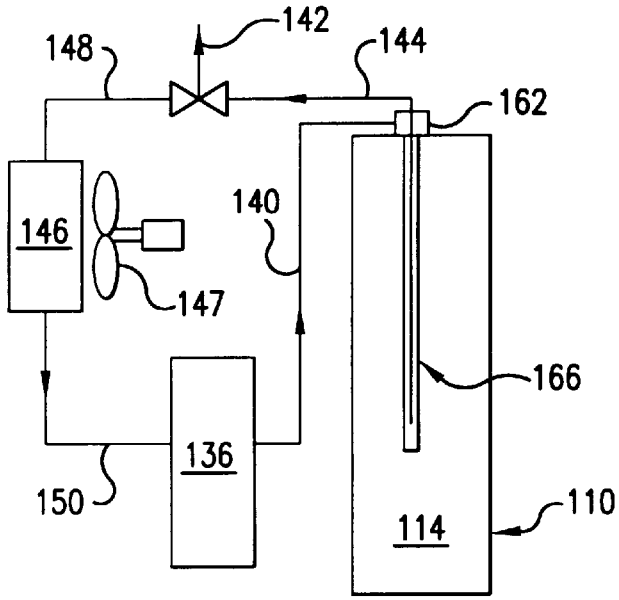
FIG. 4 is a schematic view of the major operational components of the heat pump water heater of the present invention.

The construction of the HPWH 100 includes placing the compressor 136, evaporator 146 (along with a fan 147), the expansion device 142, the control means (not shown) and associate refrigerant conduits 140, 144, 148 and 150, as shown schematically in FIG. 4, within a circular housing 160 which fits on top 126 of the water heater 110, as shown in FIG. 3.

Figure 5:
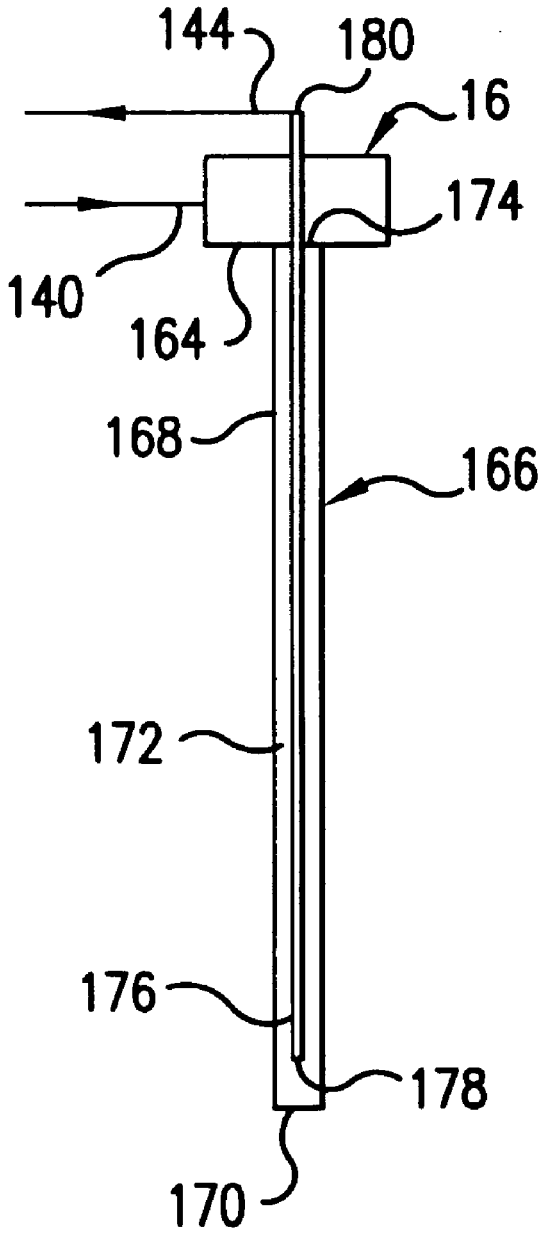
FIG. 5 is a vertical cross-sectional schematic view of the condenser assembly of the present invention.

However, any suitable means can be employed to secure the connector 162 to the opening in the top 126. The bottom surface 164 can have a neck portion (not shown) with threads thereon which are complimentary in shape to the threaded openings in the top 126. With the first embodiment of HPWH 100, the condenser assembly 138, as shown in FIG. 5, includes a union-type connector 162 with a bottom surface 164 which is used to fasten the assembly 138 to the tank top 126 through one of the existing ¾" threaded openings in the top 126. Extending into the interior of the connector 162 is the first conduit line 140 which exits from compressor 136.

Vertically depending from the bottom surface 164 of the connector 162 is a tube-in-a-tube cylindrical assembly 166 formed of an outer body 168 having a closed bottom 170 which define an inner refrigerant chamber 172 that is in fluid communication with the first refrigerant conduit 140 through the opposed upper end 174 of the outer body 168. Co-axially disposed within the refrigerant chamber 172 is a hollow inner body 176 having an open bottom 178 that is disposed above the bottom 170 and an opposed top 180 which is in flow communication with the second refrigerant conduit 144.

The superheated vapor from the first refrigerant conduit 140 enters the connector 162 into the upper end 174 of the outer body 168 and condenses downwardly along the inner wall of the outer body 168. The beat thereby released is transferred to the water in the tank 114 through the wall of the outer body 168. The condenser refrigerant collects within the refrigerant chamber 172 and flows up the inner body 176 through bottom 178 and into the second refrigerant conduit 144 through top 180.

Because the tank water is potable water, appropriate codes usually require that a heat exchanger, such as the outer body 168, be double-walled. Doucette Industries, Inc. and similar manufacturers provide vented double-wall heat exchangers specifically designed for water heating purposes. The surface area of the outer body 168 strongly affects the overall heat transfer coefficient with the higher surface enhancement, giving the better heat transfer.

In the second embodiment of the present invention, the overall construction of the condenser assembly is similar to condenser assembly 166 except that the outer body 168, in addition to acting as a heat exchanger, will also function as the sacrificial anode in the water tank 114. That is accomplished by forming the outer body 168 of a second metal which is capable of corroding at a rate greater than the rate of corrosion of the first metal of the water tank 114. The second metal can be selected from the group consisting of aluminum, magnesium or zinc. The inner body 176 can be constructed of copper. The operation of the condenser assembly of the second embodiment is identical to that of the condenser assembly 168 of the first embodiment.

The length of the condenser assembly 166 for both the first and second embodiments can vary up to approximately the height of the water tank 114. The outer and inner bodies 168, 176 can be of any conventional shapes.

The superheated refrigerant is fed into the interior of the outer body, which has an appropriately shaped outer heat exchange surface, for thermal transfer to the body of the water within the water chamber. The refrigerant then passes through the bottom of an inner tube or body to be directed in an opposite direction out of the condenser assembly to the expansion device through the second refrigerant conduit.

The following analyses, based on natural convective heat transfer alone between water and the condenser assembly of the present invention tube, without any disturbance, show that the condenser assembly can deliver over 3,000 Btu/h when the water-refrigerant temperature differential is around 20° F. or higher. This is based on using commercially available enhanced heat exchanger tube. With more advanced surface enhancement, the he at exchange rate will be even higher.

I.1. Equations

The condenser assembly heat transfer calculation is based on natural convection taken from 1997 ASHRAE Fundamentals Handbook "Heat Transfer" chapter equation (4) on P.3.12.

$$Nu=0.13*(Gr*Pr)^{0.33}$$

Where Nu=Nusselt Number
Gr=Grashof Number
Pr=Prandtl Number
$Nu=h_w*L/K$
$Gr=L*L*L*\rho*\rho*g*\beta*\Delta T/(\mu*\mu)$
$Pr=Cp*\mu K$
Where L=condenser assembly tube length, ft
$\rho$=water density, lb/ft$^3$
g=gravitational constant, 32.2 ft/sec$^2$ (32.2*3600*3600 ft/h$^2$)
$\beta$=water coefficient of expansion, ° R$^{-1}$
$\Delta T$=Temperature difference between water and tube wall, ° F.
$\mu$=water viscosity, lb/(h-ft)
Cp=Specific heat of water, Btu/lb-° F.)
K=water thermal conductivity, Btu/(h-ft-° F.)
$h_w$=water-side natural convective heat transfer coefficient, Btu/(h-ft-° F.)

The heat transfer coefficient calculated will be combined with the refrigerant-side convective heat transfer coefficient, $h_r$, so that the overall heat transfer coefficient is as follows:

$$U_1=1/(1/h_w+1/h_r)$$

where $h_r$ is assumed to be 800 Btu/(h-ft-° F.).

Here, the conductive heat transfer resistance of the thin metal tube wall is assumed to be very small.

I.2. Calculation of Convective Heat Transfer Coefficients

I.2.1 Heat transfer coefficients calculated with natural convective equations

In order to characterize the condenser assembly heat transfer by natural convection, the condenser assembly heat transfer convective heat transfer coefficients at different tank water temperatures will be calculated. The calculation will be based on the assumption of a temperature difference between water and the condenser assembly tube, and on the equations shown in I.1. This will be a conservative estimation of the heat transfer coefficient, because it assumes no external water disturbances. Also, the effect of the tank wall is not considered.

I.2.2 Heat transfer coefficients calculated with compressor beating capacities

The total heat transfer coefficients will also be calculated by means of the designed water heating capacities at different tank water temperatures. This is usually accomplished by using the compressor heating capacities at different condensing temperatures. The calculation is straightforward, based on the following heat transfer equation.

$$\text{(Water Heating Capacity)}Q=U_2*A*\Delta T$$

or $$U_2=Q/(A*\Delta T)$$

where Q is the compressor heating capacity, in Btu/h, and A is the condenser assembly tube surface area, in ft$^2$ and $U_2$ is considered the baseline overall heat transfer coefficient, in Btu/(h-ft$^2$-° F.).

I.3. Comparison of Calculated Heat Transfer Coefficients

Heat transfer coefficients calculated by the above two methods were compared, with the ones calculated at I.2.2 as the baseline data. If the coefficient calculated in I.2.1, at the same operating conditions, is equal or higher than that from the baseline calculation, it indicates that the heat transfer by natural convection is adequate.

II. Other Considerations of Condenser Assembly Design

1. Condenser assembly tube surface enhancement

The surface area of the condenser assembly tube will strongly affect the overall heat transfer coefficient. If the area enhancement factor is 2, for example, $U_2$ will be cut by one-half The higher the surface enhancement of the condenser assembly tube, the better the heat transfer. Surface area enhancement is probably the most important factor in improving the condenser assembly performance.

2. Compressor heating capacity

Because the compressor considered in the condenser assembly HPWH design was a Danfoss Model FF-GK unit, and its compressor heating capacity map was not available to us, a Copeland compressor model JR25C1E unit was used with a heat rejection rate close to that of the Danfoss unit at 25° F. evaporator temperature. The compressor heating capacities were curve fitted and formed into an equation as used in a computer program. Table I shows the compressor heat rejection rates and the curve-fitted equation.

TABLE I

COMPRESSOR HEAT DISSIPATION

| RATING CONDITIONS<br>85° F. Return Gas<br>0° F. Sub Cooling<br>95° F. Ambient Air Over<br>60 Hz Operation | HIGH TEMPERATURE<br>HFC-134a Requires Use of<br>Polyol Ester Lubricant<br>Approved By Copeland Corp.<br>Bulletin AE-1248 | JR26C1E 1 PHASE<br>COPELAWELD ® HFC-134a<br>COMPRESSOR<br>115-1-60 –IAA |
|---|---|---|

| Condensing | | CAPACITY (BTU/HR) Evaporating Temperature | | | | | | | | | | | |
|---|---|---|---|---|---|---|---|---|---|---|---|---|---|
| Temperature | | −10 | 0 | 5 | 10 | 15 | 20 | 25 | 30 | 35 | 40 | 45 | 55 |
| ° F. | (° C.) | (−23.3) | (−17.8) | (−15) | (−12.2) | −(9.4) | (−6.7) | (−3.9) | (−1.1) | (1.7) | (4.4) | (7.2) | (12.8) |
| 70 | (21.1) | 1040 | 1400 | 1610 | 1860 | 2130 | 2490 | 2770 | 3140 | 3560 | 4010 | 4520 | 5670 |
| 80 | (26.7) | 920 | 1270 | 1480 | 1710 | 1970 | 2280 | 2580 | 2930 | 3320 | 3760 | 4220 | 5300 |
| 90 | (32.2) | 800 | 1140 | 1340 | 1560 | 1800 | 2070 | 2370 | 2700 | 3070 | 3470 | 3910 | 4920 |
| 100 | (37.8) | 680 | 1010 | 1200 | 1410 | 1630 | 1890 | 2160 | 2470 | 2810 | 3180 | 3590 | 4530 |
| 110 | (43.3) | — | 880 | 1080 | 1250 | 1470 | 1700 | 1950 | 2240 | 2550 | 2890 | 3260 | 4130 |
| 120 | (48.9) | — | 770 | 930 | 1110 | 1310 | 1520 | 1750 | 2010 | 2290 | 2600 | 2940 | 3730 |
| 130 | (54.4) | — | — | — | 980 | 1160 | 1350 | 1560 | 1780 | 2040 | 2310 | 2620 | 3330 |
| 140 | (60.0) | — | — | — | — | 1030 | 1200 | 1380 | 1580 | 1800 | 2040 | 2310 | 2940 |

| Condensing | | POWER (WATTS) Evaporating Temperature | | | | | | | | | | | |
|---|---|---|---|---|---|---|---|---|---|---|---|---|---|
| Temperature | | −10 | 0 | 5 | 10 | 15 | 20 | 25 | 30 | 35 | 40 | 45 | 55 |
| ° F. | (° C.) | (−23.3) | (−17.8) | (−15) | (−12.2) | −(9.4) | (−6.7) | (−3.9) | (−1.1) | (1.7) | (4.4) | (7.2) | (12.8) |
| 0 | (21.1) | 200 | 230 | 240 | 250 | 260 | 270 | 270 | 280 | 280 | 290 | 290 | 290 |
| 80 | (26.7) | 200 | 230 | 250 | 260 | 270 | 280 | 290 | 300 | 300 | 310 | 320 | 330 |
| 90 | (32.2) | 200 | 240 | 250 | 260 | 280 | 290 | 300 | 310 | 320 | 330 | 340 | 370 |
| 100 | (37.8) | 200 | 240 | 250 | 270 | 280 | 300 | 310 | 330 | 340 | 380 | 370 | 400 |
| 110 | (43.3) | — | 240 | 260 | 270 | 290 | 310 | 320 | 340 | 360 | 30 | 390 | 430 |
| 120 | (48.9) | — | 240 | 260 | 280 | 300 | 310 | 330 | 350 | 30 | 390 | 410 | 460 |
| 130 | (54.4) | — | — | — | 280 | 300 | 320 | 340 | 380 | 380 | 410 | 430 | 480 |
| 140 | (60.0) | — | — | — | — | 300 | 330 | 350 | 370 | 390 | 420 | 450 | 500 |

| Condensing | | CURRENT (AMPS) @ 115 Volts | | | | | | | | | | | |
|---|---|---|---|---|---|---|---|---|---|---|---|---|---|
| Temperature | | −10 | 0 | 5 | 10 | 15 | 20 | 25 | 30 | 35 | 40 | 45 | 55 |
| ° F. | (° C.) | (−23.3) | (−17.8) | (−15) | (−12.2) | −(9.4) | (−6.7) | (−3.9) | (−1.1) | (1.7) | (4.4) | (7.2) | (12.8) |
| 70 | (21.1) | 3.7 | 3.9 | 3.9 | 4.0 | 4.0 | 4.0 | 4.1 | 4.1 | 4.1 | 4.1 | 4.2 | 4.2 |
| 80 | (26.7) | 3.7 | 3.9 | 3.9 | 4.0 | 4.0 | 4.1 | 4.1 | 4.2 | 4.2 | 4.3 | 4.3 | 4.4 |
| 90 | (32.2) | 3.7 | 3.9 | 4.0 | 4.0 | 4.1 | 4.2 | 4.2 | 4.3 | 4.4 | 4.4 | 4.5 | 4.8 |
| 100 | (37.8) | 3.7 | 3.9 | 4.0 | 4.0 | 4.1 | 4.2 | 4.3 | 4.4 | 4.4 | 4.5 | 4.8 | 4.9 |
| 110 | (43.3) | — | 3.9 | 4.0 | 4.1 | 4.1 | 4.2 | 4.3 | 4.4 | 4.5 | 4.7 | 4.8 | 5.0 |
| 120 | (48.9) | — | 3.9 | 4.0 | 4.1 | 4.2 | 4.3 | 4.4 | 4.5 | 4.6 | 4.8 | 4.9 | 5.2 |
| 130 | (54.4) | — | — | — | 4.1 | 4.2 | 4.3 | 4.4 | 4.6 | 4.7 | 4.9 | 5.0 | 5.4 |
| 140 | (60.0) | — | — | — | — | 4.2 | 4.3 | 4.5 | 4.6 | 4.8 | 4.9 | 5.1 | 5.6 |

| Condensing | | MASS FLOW (LBS/HR) Evaporating Temperature | | | | | | | | | | | |
|---|---|---|---|---|---|---|---|---|---|---|---|---|---|
| Temperature | | −10 | 0 | 5 | 10 | 15 | 20 | 25 | 30 | 35 | 40 | 45 | 55 |
| ° F. | (° C.) | (−23.3) | (−17.8) | (−15) | (−12.2) | −(9.4) | (−6.7) | (−3.9) | (−1.1) | (1.7) | (4.4) | (7.2) | (12.8) |
| 70 | (21.1) | 13 | 17 | 20 | 23 | 26 | 30 | 35 | 39 | 45 | 50 | 60 | 70 |
| 80 | (26.7) | 12 | 16 | 19 | 22 | 26 | 29 | 34 | 38 | 44 | 50 | 60 | 70 |
| 90 | (32.2) | 11 | 15 | 18 | 21 | 24 | 28 | 32 | 37 | 42 | 50 | 50 | 70 |
| 100 | (37.8) | 9 | 14 | 17 | 20 | 23 | 27 | 31 | 36 | 41 | 50 | 50 | 70 |
| 110 | (43.3) | — | 13 | 16 | 19 | 22 | 26 | 30 | 34 | 39 | 40 | 50 | 60 |
| 120 | (48.9) | — | 12 | 15 | 18 | 21 | 24 | 28 | 32 | 37 | 42 | 48 | 62 |
| 130 | (54.4) | — | — | — | 17 | 20 | 23 | 26 | 31 | 35 | 40 | 46 | 59 |
| 140 | (60.0) | — | — | — | — | 19 | 22 | 25 | 29 | 33 | 38 | 43 | 56 |

Nominal Performance Values (±5%) based on 72 hours run-in. Subject to change without notice.

The compressor heat dissipation rates are calculated by adding the cooling capacity and the power consumption of the Copeland compressor model JR26C1E at 25° F. evaporation.

Curve-fitted compressor heat dissipation equation:

$$Q=-16.427*T+4860.7$$

Where T is in ° F.

III. Results and Discussions

A Fortran computer code was written to calculate the heat transfer coefficients at different temperature differentials between the condenser assembly tube and tank water. Table II shows the computer code.

TABLE II

COMPUTER CODE FOR HEAT TRANSFER COEFFICIENT CALCULATION

```
cp = specific heat of water, Btu/lb/F.
dmu = viscosity of water, lb/h/ft
dl = length of IDX heat exchanger, in ft
t = water temperature, F.
a = IDX surface, ft2
hr = IDX refrigerant-side heat transfer coefficient, Btu/h/F/ft2
dt = Temperature differential between water and refrigerant, F.
g = gravitational constant, 32.2 ft/sec/sec
qw = curve fitted compressor heating capacity
h1 = total heat transfer coefficient, calculation is based on qw, Btu/h/f/ft2
dk = thermal conductivity of water, curve fitted data as a function of water
temperature
de = IDX tube surface enhancement factor
cp = 1.0
dmu = 0.7 * 2.42
dl = 4.0
de = 2.0
Tank water initial temperature is set at 60 F.
t = 60.
a = .875*3.14159*d1*de/12.
hr = 800.0
dt = 15.
g = 32.2
h1 = 3600./a/dt
do 30 j = 1,6
do 20 i = 1,15
curve-fitted equation for compressor heat dissipation
at 25 F. evaporating temperature

qw = −1.6427E1*t + 4.8607E3
h1 = qw/a/dt
curve-fitted equation for viscosity of water

dmu = (1.0862E − 4)*t*t − (3.0853E − 2)*t + 2.6287
dmu = dmu*2.42
curve-fitted equation for water thermal conductivity

dk = (1.4049E − 6)*t*t + (8.6081E − 5)*t + 0.33805
curve-fitted equation for water density

rho = (2.1536E − 8)*t*t − (1.0905E − 6)*t + 1.602E − 2
rho = 1./rho
curve-fitted equation for water volume thermal
expansion coefficient

x = (t-32.)/1.8
beta = (−6.9612E − 2)*x*x + 1.3358E1*x − 35.442
beta = beta/1.8*1.0E − 6
pr = cp*dmu/dk
gr = (d1**3) * (rho**2)*g*3600*3600*beta*dt/(dmu**2)
dnu = 0.13*(pr*gr)**0.33
h = dnu*dk/dl
ho = 1./(1./h + 1./hr)
write (8,10) cp,dmu,dk,dl,t,rho,g,beta,dt,pr,gr,dnu,ho,h1
format (5f10.3,/,5f10.4,/,f16.0,3f10.4)
t = t + 5.
continue
t = 60.
dt = dt + 5.
continue
stop
end
```

The following water properties were curve-fitted and used in the computer code.

1. Thermal Conductivity Data were taken from McAdams "Heat Transmission", third edition, p. 456. McGraw-Hill, 1954. Curve-fitted equation:

$$K=1.4049E\text{-}6*T*T+8.6081E\text{-}5*T+3.3805E\text{-}1$$

where T is in ° F.

2. Viscosity Data were taken from McAdams "Heat Transmission", third edition, p. 466. McGraw-Hill, 1954. Curve-fitted equation:

$$\mu=1.0862E\text{-}4*T*T-3.0853E\text{-}2*T+2.6287$$

where $\mu$ is in centipoises, T in ° F. To convert $\mu$ into PI units, it should be multiplied by 2.42.

3. Coefficient of Thermal Expansion Data were taken from the "Handbook of Chemistry and Physics", P. F5, 54$^{th}$ edition, 1973–1974, CRC Press. Curve-fitted equation:

$$\beta=(-6.9612E\text{-}2*T*T+1.3358E1*T-3.5442E1)*10^{-6}$$

where T is in ° C. For PI units, β should be divided by 1.8.

4. Density of Water Data were taken from ASHRAE Handbook Fundamentals 1989, P. 6.9–6.10. Curve-fitted equation:

$$V_S(\text{specific volume})=2.1536E\text{-}8*T*T-1.0905E\text{-}6*T+1.602E\text{-}2\quad \rho(\text{density})=1/V_S$$

where T is in ° F. and $V_S$ is in ft$^3$/lb. Table III shows the comparison of the calculated total heat transfer coefficients. The baseline heat transfer coefficients decrease as the temperature of the tank water increases. This is because the compressor heating capacity decreases as the condensing temperature increases. On the other hand, the total heat transfer coefficients with natural convection water on the condenser assembly tube and water increases as the tank water temperature increases. This is because natural convective heat transfer becomes more effective as the coefficient of expansion β increases with tank water temperature.

TABLE III

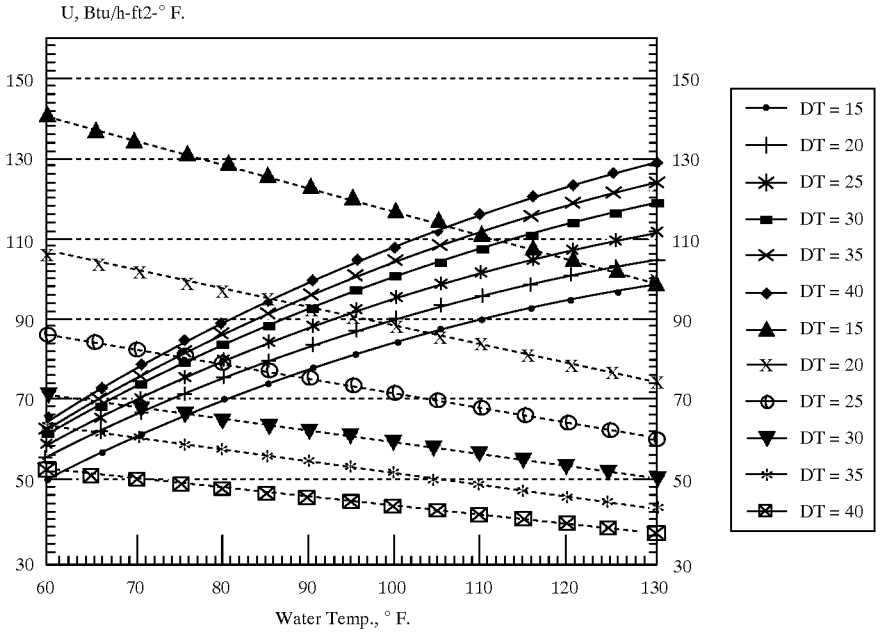

Comparison of overall heat transfer coefficients

Surface enhanced by a factor of 2
7/8″ Copper tubing
Condenser is 4.0 feet long

At low tank water temperature, such as 60 to 80° F., the temperature differentials between water and refrigerant will be very high. A temperature differential of 25° F. will be enough to transfer the designed heating capacity at 80° F. water temperature. At 100° F. water, for example, a temperature differential of 20° F. will be adequate. At 130° F., the temperature differential requirement drops to 15° F. With water in the tank disturbed, for example by the in-flow of the cold water, the heat transfer coefficient will be even higher. The following table shows the heat transfer rate the condenser assembly can theoretically deliver at various temperature differentials. The table shows that when water is at 95° F., a 20° F. temperature (or 115° F. condensing) will have a heat transfer rate of over 3,000 Btu/h. Even at 100° F. condensing, the condenser assembly still can deliver 2,110 Btu/h. This indicates that the condenser assembly concept will work as expected.

TABLE IV

Condenser Assembly Heat transfer rate*

| Refrigerant and Tank Water Temperature Differential, ° F. | Condenser assembly Overall Heat Transfer Coefficient U, Btu/(h-ft$^2$-° F.) | Heat Transfer Rate, Btu/h |
|---|---|---|
| 15 | 76.76 | 2110 |
| 20 | 83.61 | 3064 |
| 25 | 89.28 | 4090 |
| 30 | 94.17 | 5177 |
| 35 | 98.48 | 6316 |
| 40 | 102.35 | 7502 |

*Surface enhancement factor is assumed 2.0, tank water temperature is 95° F.

The condenser assembly concept, based on the calculation, can meet the designed heating load requirement.

What is claimed is:

1. An improved heat pump water heater of the type having a water tank with an exterior surface and defining a water chamber, a top on the water tank with at least one opening therethrough in communication with the water chamber, and a heat pump of the type having a compressor, the compressor being in fluid communication with a condenser assembly via a first refrigerant conduit, the condenser assembly being in fluid communication with an expansion device through a second refrigerant conduit, the expansion device being in fluid communication with an evaporator through a third refrigerant conduit, the evaporator being in fluid communication with the compressor through a forth refrigerant conduit and control means therefor, the improvement comprising:

disposing the condenser assembly through the opening in the top of the water tank and into the water chamber, the condenser assembly comprising an elongate outer body having a closed bottom end and an open and opposed upper end in flow communication with the first refrigerant conduit, and an elongate inner body disposed within the outer body and having an open bottom end and a closed and opposed top end in flow communication with the second refrigerant conduit.

2. An improved heat pump water heater as claimed in claim 1 wherein the compressor, the first refrigerant conduit, the expansion device, the second refrigerant conduit, the expansion valve, the evaporator, the third refrigerant conduit, the fourth refrigerant conduit and the control means are disposed on the water tank.

3. An improved heat pump water heater as claimed in claim 1 and further comprising a housing disposed on the top of the water tank and containing therein the compressor. An improved heat pump water heater as claimed in claim 1 wherein the compressor, the first refrigerant conduit, the expansion device, the second refrigerant conduit, the expansion valve, the evaporator, the third refrigerant conduit, the fourth refrigerant conduit and the control means are disposed on the water tank.

4. An improved heat pump water heater as claimed in claim 1 wherein the outer body and the inner body are constructed of copper.

5. An improved heat pump water heater of the type having a water tank with an exterior surface and defining a water chamber, a top on the water tank with at least one opening therethrough in communication with the water chamber and a heat pump of the type having a compressor being in fluid communication with a condenser assembly via a first refrigerant conduit, the condenser assembly being in fluid communication with an expansion device through, a second refrigerant conduit, the expansion device being in fluid communication with an evaporator through a third refrigerant conduit, the evaporator being in fluid communication with the compressor through a fourth refrigerant conduit and control means therefor, the condenser assembly being disposed through the opening into the water chamber and comprising an outer body having a closed bottom, an opposed upper end which is in flow communication with the first refrigerant conduit and an inner body disposed within the outer body and having an open bottom and an opposed top which is in flow communication with the second refrigerant conduit, the improvement comprising:

a water tank constructed of a first metal and wherein the outer body is constructed of a second metal which is capable of corroding at a rate greater than the rate of corrosion of the first metal.

6. An improved heat pump water heater as claimed in claim 5 wherein the second metal is selected from the group consisting of aluminum, magnesium or zinc.

7. An improved heat pump water heater as claimed in claim 5 wherein the inner body is formed of copper.

8. An improved heat pump water heater of the type having a water tank with an exterior surface and being formed of a first metal and defining a water chamber, a top on the water tank with at least one opening therethrough for an anode rod to be disposed within the water chamber and a heat pump of the type having a compressor being in fluid communication with a condenser assembly via a first refrigerant conduit, the condenser assembly being in fluid communication with an expansion device through a second refrigerant conduit, the expansion device being in fluid communication with an evaporator through a third refrigerant conduit, the evaporator being in fluid communication with the compressor through a fourth refrigerant conduit and control and means therefor, the improvement comprising:

the condenser assembly comprising an outer body formed of a second metal capable of corroding at a rate greater than the rate of corrosion of the first metal and having a closed bottom, an opposed upper end which is in flow communication with the first refrigerant conduit and an inner body disposed within the outer body and having an open bottom and an opposed top which is in flow communication with the second refrigerant conduit.

9. An improved heat pump water heater as claimed in claim 8 wherein the compressor, the first refrigerant conduit, the expansion valve, the second refrigerant conduit, the expansion valve, the evaporator, the third refrigerant conduit and the fourth refrigerant conduit are disposed on the water tank.

10. An improved heat pump water heater as claimed in claim 8 wherein the second metal is selected from the group consisting of aluminum, magnesium or zinc.

11. An improved heat pump water heater as claimed in claim 8 wherein the inner body is formed of copper.

12. A condenser assembly for an improved heat pump water heater of the type having a water tank with an exterior surface and defining a water chamber, a top on the water tank with at least one opening therethrough in communication with the water chamber and a heat pump of the type having a compressor, said compressor being in fluid communication with the condenser assembly via a first refrigerant conduit, the condenser assembly being in fluid communication with an expansion device through a second refrigerant conduit, the expansion device being in fluid communication with an evaporator through a third refrigerant conduit, the evaporator being in fluid communication with the compressor through a fourth refrigerant conduit and control means therefor, the improvement comprising:

disposing the condenser assembly within the water chamber through the opening in the top of the water tank, the condenser assembly comprising an elongate outer body having a closed bottom end and an open and opposed upper end in flow communication with the first refrigerant conduit, and an elongate inner body disposed within the outer body and having an open bottom end and an open and opposed top end in flow communication with the second refrigerant conduit.

13. A condenser assembly for an improved heat pump water heater of the type having a water tank with an exterior surface and being formed of a first metal and defining a water chamber, a top on the water tank with at least one opening therethrough for an anode rod to be disposed within the water chamber and a heat pump of the type having a compressor being in fluid communication with the condenser assembly via a first refrigerant conduit, the condenser assembly being in fluid communication with an expansion device through a second refrigerant conduit, the expansion device being in fluid communication with an evaporator through a third refrigerant conduit, the evaporator being in fluid communication with the compressor through a fourth refrigerant conduit, the improvement comprising:

the condenser assembly comprising an outer body formed of a second metal capable of corroding at a rate greater than the rate of corrosion of the first metal and having a closed bottom, an opposed upper end which is in flow communication with the first refrigerant conduit and an inner body disposed within the outer body and having an open bottom and an opposed top which is in flow communication with the second refrigerant conduit.

14. An improved heat pump water heater as claimed in claim 13 wherein the second metal is selected from the group consisting of aluminum, magnesium or zinc.

15. An improved heat pump water heater as claimed in claim 13 wherein the inner body is formed of copper.

16. A method of constructing a heat pump water heater of the type having a water tank formed of a first metal and defining a water chamber, a top on the water tank with at least one opening therethrough for an anode rod to be disposed within the water chamber and a heat pump of the type having a compressor being in fluid communication with a condenser assembly via a first refrigerant conduit, the condenser assembly being in fluid communication with an expansion device through a second refrigerant conduit, the expansion device being in fluid communication with an evaporator through a third refrigerant conduit, the evaporator being in fluid communication with the compressor through a fourth refrigerant conduit and control means therefor, comprising the steps of:

a. removing the anode rod from the water tank; and b. inserting through the opening the condenser assembly, wherein the condenser assembly comprises an outer body formed of a second metal capable of corroding at a rate greater than the rate of corrosion of the first metal and having a closed bottom, an opposed upper end which is in flow communication with the first refrigerant conduit and an inner body disposed within the outer body and having an open bottom and an opposed top which is in flow communication with the second refrigerant conduit, whereby heat from the refrigerant in the first refrigerant conduit is transferred through the outer body to the water in the water tank and the refrigerant then travels through the inner body into the second refrigerant line.

17. A method of constructing a heat pump water heater of the type having a water tank defining a water chamber, a top on the water tank with at least one opening therethrough and a heat pump of the type having a compressor, said compressor being in fluid communication with a condenser assembly via a first refrigerant conduit, the condenser assembly being in fluid communication with an expansion device through a second refrigerant conduit, the expansion device being in fluid communication with an evaporator through a third refrigerant conduit and the evaporator being in fluid communication with the compressor through a fourth refrigerate conduit and control means therefor, comprising the steps of:

a. inserting the condenser assembly through the opening in the top of the water tank, wherein the condenser assembly comprises an elongate outer body having a closed bottom end and an open and opposed upper end in flow communication with the first refrigerant conduit, and an elongate inner body disposed within the outer body and having an open bottom end and an open and opposed top end in flow communication with the second refrigerant conduit; and b. disposing the compressor, the first refrigerant conduit expansion device, the second refrigerant conduit evaporator, the third refrigerant conduit, the fourth refrigerant conduit, and the control means within a housing on top of the water tank, whereby heat from the refrigerant passed through the first refrigerant conduit is transferred through the outer body to the water in the water tank, and the refrigerant then travels through the inner body into the second refrigerant line.

* * * * *